US005552078A

United States Patent [19]

Carr et al.

[11] Patent Number: 5,552,078

[45] **Date of Patent: *Sep. 3, 1996**

[54] CARBONATE BUILT LAUNDRY DETERGENT COMPOSITION

[75] Inventors: Charles D. Carr, Yardley, Pa.; Steven A. Bolkan, Hopewell; Joseph G. Becker, Martinsville, both of N.J.

[73] Assignee: Church & Dwight Co., Inc., Princeton, N.J.

[ * ] Notice: The term of this patent shall not extend beyond the expiration date of Pat. No. 5,376,300.

[21] Appl. No.: 360,312

[22] Filed: Dec. 21, 1994

Related U.S. Application Data

[63] Continuation-in-part of Ser. No. 85,008, Jun. 29, 1993, Pat. No. 5,376,300.

[51] Int. Cl.[6] ..... C11D 3/10; C11D 1/14

[52] U.S. Cl. ..... 510/351; 510/359; 510/361; 510/476; 510/469

[58] Field of Search ..... 252/174.14, 174.24, 252/135, 551, 174.21

[56] References Cited

U.S. PATENT DOCUMENTS

| | | | |
|---|---|---|---|
| 3,308,067 | 3/1967 | Diehl | 252/161 |
| 4,007,124 | 2/1977 | Collier et al. | 252/109 |
| 4,217,105 | 8/1980 | Goodman | 8/111 |
| 4,292,035 | 9/1981 | Battrell | 8/137 |
| 4,473,485 | 9/1984 | Greene | 252/174.12 |
| 4,521,332 | 6/1985 | Milora | 252/527 |
| 4,711,740 | 12/1987 | Carter et al. | 252/174.24 |
| 4,783,281 | 11/1988 | Bishop et al. | 252/135 |
| 4,820,441 | 4/1989 | Evans et al. | 252/174.18 |
| 4,849,125 | 7/1989 | Seiter et al. | 252/109 |
| 4,882,074 | 11/1989 | Kenyon et al. | 252/8.8 |
| 4,919,845 | 4/1990 | Vogt et al. | 252/526 |
| 5,151,208 | 9/1992 | Huijben et al. | 252/174.14 |
| 5,152,910 | 10/1992 | Savio et al. | 252/95 |
| 5,176,713 | 1/1993 | Dixit et al. | 8/137 |
| 5,198,198 | 3/1993 | Gladfelter et al. | 422/264 |
| 5,269,962 | 12/1993 | Brodbeck et al. | 252/186.25 |
| 5,332,519 | 7/1994 | Mazzola | 252/174 |
| 5,376,300 | 12/1994 | Bolkan et al. | 252/174.14 |

*Primary Examiner*—Paul Lieberman
*Assistant Examiner*—Kery Fries
*Attorney, Agent, or Firm*—Irving M. Fishman

[57] ABSTRACT

A powdered laundry detergent composition comprising an active surfactant, at least about 70 wt. % of a water soluble alkaline carbonate salt, e.g., sodium carbonate, about 0.1 to 2 wt. % of a phosphorus-containing sequestering agent, e.g., sodium tripolyphosphate (STPP), about 0.1 to 2 wt. % of a polymeric polycarboxylate, e.g., a polyacrylate or a polymaleate, and about 1–12 wt. % water. Use of the foregoing detergent composition provides excellent cleaning and whitening of fabrics while avoiding the problem of eutrophication which occurs when a substantial amount of a phosphorus containing builder such as STPP is present in the composition, and while minimizing the problem of fabric encrustation often present when the composition contains a large amount of carbonate builder.

11 Claims, No Drawings

CARBONATE BUILT LAUNDRY DETERGENT COMPOSITION

CROSS-REFERENCE TO RELATED APPLICATION

This application is a continuation-in-part of application Ser. No. 08/085,008, filed Jun. 29, 1993, now U.S. Pat. No. 5,376,300.

BACKGROUND OF THE INVENTION

1. Field of the Invention

This invention relates to novel laundry detergent compositions having a high water-soluble alkaline carbonate builder content and low fabric encrustation properties.

2. Description of the Related Art

The following information is being disclosed under the provisions of 37 CFR 1.56, 1.97 and 1.98.

It is conventional to use "builders" in detergent compositions which supplement and enhance the cleaning effect of an active surfactant present in the composition. Such builders improve the cleaning and whitening power of the detergent composition, for instance, by the sequestration or precipitation of hardness causing metal ions such as calcium and magnesium, peptization of soil agglomerates, reduction of the critical micelle concentration, and neutralization of acid soil, as well as by enhancing various properties of the active detergent, such as its stabilization of solid soil suspensions, solubilization of water-insoluble materials, emulsification of soil particles, and foaming and sudsing characteristics. Other mechanisms by which builders improve the cleaning and whitening power of detergent compositions are probably present but are less well understood. Builders are important not only for their effect in improving the cleaning and whitening ability of active surfactants in detergent compositions, but also because they allow for a reduction in the amount of the surfactant used in the composition, the surfactant being generally much more costly than the builder.

Two important classes of builders have been widely used in recent years, viz., phosphorus containing salts such as sodium tripolyphosphate (STPP) which are very effective in sequestering calcium and magnesium ions without precipitating them, and soluble alkaline carbonates such as sodium carbonates which may be used in amounts up to 90 wt. % of the composition and which effectively precipitate the calcium and magnesium ions. However phosphorus-containing builders have been found to cause a serious problem of eutrophication of lakes, rivers and streams when present in detergent compositions in relatively large amounts, resulting in the passage of laws in several states mandating a drastic reduction in their use. While the use of soluble alkaline carbonate builders do not cause eutrophication, they result in the unrelated problem of fabric encrustation caused by the precipitation of calcium and magnesium carbonates which deposit on the fiber surfaces of fabrics, causing the fabric to have a stiff hand and giving colored fabrics a faded appearance.

Polymeric polycarboxylates such as polyacrylates are also known in the detergent art as effective sequestering and dispersing agents as well as crystal growth inhibitors. However, such polycarboxylates have limited biodegradability which presents an environmental problem if they are used in relatively large amounts.

The following prior art references may be considered relevant or material to the invention claimed herein.

U.S. Pat. No. 4,473,485 issued Sep. 25, 1984 to Greene, teaches free-flowing laundry detergent powders comprising a polycarboxylic structuring agent (about 0.2–50 wt. %), a finely divided alkali or alkaline earth metal carbonate (about 1 to 80 wt. %), a detergent builder (about 1 to 98.8 wt. %), a nonionic surfactant (about 1 to 50 wt. %) and water (about 4 to 30 wt. % before removal of excess water). An additional detergent builder may be utilized, which may be a phosphorus-containing compound such as sodium tripolyphosphate (STPP) as well as any of a large number of other compounds including standard sized sodium carbonate. An anionic surfactant may also be present.

U.S. Pat. No. 4,521,332, issued Jun. 4, 1985 to Milora, discloses highly alkaline liquid cleaning compositions comprising a nonionic surfactant, 10 to 45 wt. % of sodium hydroxide, 0.04 to 4 wt. % of a polyacrylic acid salt, 0 to 15 wt. % of an alkali metal phosphate builder such as STPP, 0.5 to 20 wt. % of a "building agent" such as sodium carbonate, and 6 to 60 wt. % of water.

U.S. Pat. No. 4,711,740, issued Dec. 8, 1987 to Carter et al., discloses detergent compositions comprising a "detergent active" compound, i.e., a surfactant, a detergent builder which is a water-soluble carbonate, e.g. sodium carbonate in an amount of "at least 5% by weight, such as from 10% to 40%, preferably 10% to 30% weight, though an amount up to 75% could possible be used if desired in special products," a water insoluble carbonate, e.g., calcium carbonate (calcite) in an amount of 5 to 60 wt. %, as seed crystals for precipitated calcium carbonate which is thus prevented from being deposited on fabrics; and a copolymer of a carboxylic monomer, e.g., acrylic acid, and a non-carboxylic monomer, such copolymer being present in an amount of 0.1 to 10 wt. % and acting as a colloid stabilizer for the precipitated calcium carbonate. Other detergency builders such as STPP may also be present.

U.S. Pat. No. 4,820,441, issued Apr. 11, 1989 to Evans et al., discloses granular detergent compositions which may contain in addition to an active surfactant, 5 to 75 wt. % of a crystal growth modified, carbonate-based structurant salt, 0.1 to 20 wt. % of a polymeric polycarboxylate as crystal growth modifier based on the weight of the structurant salt, and 0 to 40 wt. % of STPP. The structurant salt may contain sodium sulfate as well as sodium carbonate and sodium bicarbonate, and the two tables under the heading "PRODUCTS OF THE INVENTION" in columns 8 and 9 of the patent show a maximum of 40 wt. % of sodium carbonate in the final product composition.

U.S. Pat. No. 4,849,125, issued Jul. 18, 1989 to Seiter et al., discloses phosphate-reduced, granular, free-flowing detergent compositions comprising 4 to 40 wt. % of a nonionic surfactant, 3 to 20 wt. % of an anionic surfactant, 0.5 to 15 wt. % of a homopolymeric or copolymeric carboxylic acid or salt, 0 to 20 wt. % of STPP, and, optionally, up to 15 or 20 wt. % of sodium carbonate.

U.S. Pat. No. 5,152,910, issued Oct. 6, 1992 to Savio et al., teaches low-phosphate machine dishwashing compositions which may contain an alkali metal carbonate, an alkaline condensed phosphate salt, a polymeric polycarboxylate mixture, and a nonionic surfactant.

SUMMARY OF THE INVENTION

In accordance with this invention a powdered laundry detergent composition is provided comprising an active surfactant, at least about 70 wt. % of a water soluble alkaline carbonate salt, about 0.1 to 2 wt. % of a phosphorus-containing sequestering agent, about 0 1 to 2 wt. % of a polymeric polycarboxylate, and about 1 to 12 wt. % water.

Use of the foregoing detergent composition provides excellent cleaning and whitening of fabrics while avoiding the problem of eutrophication which occurs when a substantial amount, e.g., over about 5–10% of a phosphorus containing builder such as STPP is present in the composition, and while minimizing the problem of fabric encrustation often present when the composition contains a large amount of carbonate builder. Furthermore, the effect of the combination of the indicated small amounts of the phosphorus-containing sequestering agent and polymeric polycarboxylate in minimizing fabric encrustation and improving the cleaning and whitening effect of the detergent composition has been found to be greater than would be expected from the effect of each of these components when used alone.

DETAILED DESCRIPTION OF THE INVENTION

The active surfactant component present in the laundry detergent composition of this invention may consist of one or more of many suitable synthetic detergent active compounds which are commercially available and described in the literature, for example, in "Surface Active Agents and Detergents," Volumes 1 and 2 by Schwartz, Perry and Berch. Several detergents and active surfactants are also described in, for example, U.S. Pat. Nos. 3,957,695; 3,865,754; 3,932,316 and 4,009,114. In general, the detergent composition may include a synthetic anionic, nonionic, amphoteric or zwitterionic detergent active compound, or mixtures of two or more of such compounds.

Preferably, the laundry detergent compositions of this invention contain at least one anionic or nonionic surfactant, and, more preferably, a mixture of the two types of surfactant.

The contemplated water soluble anionic detergent surfactants are the alkali metal (such as sodium and potassium) salts of the higher linear alkyl benzene sulfonates and the alkali metal salts of sulfated ethoxylated and unethoxylated fatty alcohols, and ethoxylated alkyl phenols. The particular salt will be suitably selected depending upon the particular formulation and the proportions therein.

The sodium alkybenzenesulfonate surfactant (LAS), if used in the composition of the present invention, preferably has a straight chain alkyl radical of average length of about 11 to 13 carbon atoms.

Specific sulfated surfactants which can be used in the compositions of the present invention include sulfated ethoxylated and unethoxylated fatty alcohols, preferably linear primary or secondary monohydric alcohols with $C_{10}$–$C_{18}$, preferably $C_{12}$–$C_{16}$, alkyl groups and, if ethoxylated, on average about 1–15, preferably 3–12 moles of ethylene oxide (EO) per mole of alcohol, and sulfated ethoxylated alkylphenols with $C_8$–$C_{16}$ alkyl groups, preferably $C_8$–$C_9$ alkyl groups, and on average from 4–12 moles of EO per mole of alkyl phenol.

The preferred class of anionic surfactants are the sulfated ethoxylated linear alcohols, such as the $C_{12}$–$C_{16}$ alcohols ethoxylated with an average of from about 1 to about 12 moles of ethylene oxide per mole of alcohol. A most preferred sulfated ethoxylated detergent is made by sulfating a $C_{12}$–$C_{15}$ alcohol ethoxylated with 3 moles of ethylene oxide per mole of alcohol.

Specific nonionic surfactants which can be used in the compositions of the present invention include ethoxylated fatty alcohols, preferably linear primary or secondary monohydric alcohols with $C_{10}$–$C_{18}$, preferably $C_{12}$–$C_{16}$, alkyl groups and on average about 1–15, preferably 3–12 moles of ethylene oxide (EO) per mole of alcohol, and ethoxylated alkylphenols with $C_8$–$C_{16}$ alkyl groups, preferably $C_8$–$C_9$ alkyl groups, and on average about 4–12 moles of EO per mole of alkyl phenol.

The preferred class of nonionic surfactants are the ethoxylated linear alcohols, such as the $C_{12}$–$C_{16}$ alcohols ethoxylated with an average of from about 1 to about 12 moles of ethylene oxide per mole of alcohol. A most preferred nonionic detergent is a $C_{12}$–$C_{15}$ alcohol ethoxylated with 3 moles of ethylene oxide per mole of alcohol.

Mixtures of the foregoing synthetic detergent type of surfactants, e.g., of anionic and nonionic, or of different specific anionic or nonionic surfactants, may be used to modify the detergency, sudsing characteristics, and other properties of the composition. For example, a mixture of different fatty alcohols of 12 to 15 carbon atoms may be ethoxylated, directly sulfated, or sulfated after ethoxylation, a fatty alcohol may be partially ethoxylated and sulfated, or an ethoxylated fatty acid may be partially sulfated to yield a mixture of different anionic and nonionic surfactants or different specific anionic or nonionic surfactants.

The total active surfactant in the composition may be in the range, for example, of about 5 to 24 wt. %, preferably about 5 to 15 wt. % and most preferably about 8 to 12 wt. %. If, as preferred, the active surfactant consists of a combination of anionic and nonionic surfactants, then the anionic surfactant is present in the range, for example, of about 4 to 16 wt. %, preferably about 5 to 10 wt. %, and the nonionic surfactant is present in the range, for example, of about 2 to 8 wt. %, preferably about 3 to 5 wt. %.

The water-soluble alkaline carbonate may be, for example, an alkali metal carbonate, bicarbonate or sesquicarbonate, preferably sodium or potassium carbonate, bicarbonate or sesquicarbonate, and most preferably sodium carbonate. A combination of more than one of such compounds may be used, e.g., sodium carbonate and sodium bicarbonate. The total water-soluble alkaline carbonate may be present in an amount, for example, of about 70 to 90 wt. %, preferably about 75 to 85 wt. %. If a combination of alkali metal carbonate and bicarbonate is used as the water-soluble carbonate, then the alkali metal carbonate, e.g., sodium carbonate, is preferably used in an amount of about 75 to 80 wt. % and the alkali metal bicarbonate, e.g., sodium bicarbonate, in an amount of about 0.1 to 15 wt. %.

The phosphorus-containing sequestering agent may be, for example, an inorganic phosphate, e.g., a soluble orthophosphate, metaphosphate, pyrophosphate or preferably a polyphosphate, such as an alkali metal phosphate of the type delineated, preferably a sodium or potassium tripolyphosphate. Organic phosphonates may also be employed as the phosphorus containing sequestering agent, particularly aminomethylenephosphonates (e.g., sold by Monsanto Company under the trademark "DEQUEST"), such as aminotri(methylenephosphonic acid) (ATMP), ethylenediaminetetra(methylenephosphonic acid) (EDTMP), hexamethylenediaminetetra(methylenephosphonic acid) (HMDTMP), and diethylenetriaminepenta(methylenephosphonic acid) (DETPMP). The most preferred phosphorus-containing sequestering agent is sodium tripolyphosphate (STPP).

The phosphorus-containing sequestering agent may be present in the detergent composition in an amount, for example, of about 0.1 to 2 wt. %, preferably about 0.15 to 2 wt. %.

The polymeric polycarboxylate is a homopolymer or copolymer (composed of two or more co-monomers) of an alpha, beta-ethylenically unsaturated acid monomer such as acrylic acid, methacrylic acid, a diacid such as maleic acid, itaconic acid, fumaric acid, mesoconic acid, citraconic acid and the like, monoesters of diacids with alkanols, e.g., having 1–8 carbon atoms, and mixtures thereof. When the polymeric polycarboxylate is a copolymer, it may be a copolymer of more than one of the foregoing unsaturated acid monomers, e.g., acrylic acid and maleic acid, or a copolymer of at least one of such unsaturated acid monomers with at least one non-carboxylic alpha, beta-ethylenically unsaturated monomer which may be either non-polar such as styrene or an olefinic monomer, such as ethylene, propylene or butene-1, or which has a polar functional group such as vinyl acetate, vinyl chloride, vinyl alcohol, alkyl acrylates, vinyl pyridine, vinyl pyrrolidone, or an amide of one of the delineated unsaturated acid monomers, such as acrylamide or methacrylamide. Certain of the foregoing copolymers may be prepared by aftertreating a homopolymer or a different copolymer, e.g., copolymers of acrylic acid and acrylamide by partially hydrolyzing a polyacrylamide.

Copolymers of at least one unsaturated carboxylic acid monomer with at least one non-carboxylic comonomer should contain at least about 50 mol % of polymerized carboxylic acid monomer.

A preferred group of polymeric polycarboxylates are homopolymers of maleic acid, and copolymers of acrylic acid and maleic acid in all proportions of the two monomers. Particularly preferred are copolymers of about 50 to about 90 wt. % of acrylic acid and correspondingly, about 50 to about 10 wt. % of maleic acid.

The polymeric polycarboxylate should have a number average molecular weight of, for example about 1000 to 10,000, preferably about 2000 to 5000. To ensure substantial water solubility, the polymeric polycarboxylate is completely or partially neutralized, e.g., with alkali metal ions, preferably sodium ions.

The polymeric polycarboxylate is present in the detergent composition in an amount of about 0 1 to 2 wt. % preferably about 0.1 to 1.5 wt. %.

Finally, water is generally present in an amount of about 1–12 wt. %, preferably about 2–10 wt. %.

The laundry detergent compositions of this invention may also contain various adjuvants common to detergent formulations such as brighteners, enzymes, carboxymethylcellulose, perfumes, dyes and peroxide generating persalts.

The following examples further illustrate the invention. In these examples, the water hardness is given as the total of Ca and Mg expressed as ppm or mg/L of $CaCO_3$ using the standard test method described in ASTM D-1126, together with the molar ratio of calcium to magnesium (Ca/Mg).

EXAMPLE 1 AND COMPARATIVE EXAMPLE A AND B

These examples illustrate the unexpectedly low amount of fabric encrustation obtained with the detergent compositions of this invention.

In Example 1, the following components were compounded to formulate a laundry detergent composition under this invention. All quantities are given in parts by weight: 80 parts of sodium carbonate; 0.5 part of sodium bicarbonate; 6.0 parts of the sodium salt of a sulfated $C_{12}$–$C_{15}$ alcohol ethoxylated with 3 moles of ethylene oxide per mole of alcohol (anionic surfactant); 3.2 parts of a $C_{12}$–$C_{15}$ alcohol ethoxylated with 3 moles of ethylene oxide per mole of alcohol (nonionic surfactant); 1.0 part of sodium tripolyphosphate (STPP); 0.5 part of a sodium polyacrylate having a weight average molecular weight of about 4500; and 8.8 parts of water.

In Comparative Example A the same components were compounded as shown for Example 1 except that the STPP was omitted and 1.5 parts rather than 0.5 part of sodium polyacrylate were utilized.

In Comparative Example B, the same components were compounded as shown for Example 1, except that the sodium polyacrylate was omitted and 9.3 rather than 8.8 parts of water were present.

The detergent compositions of Example 1 and Comparative Examples A and B were tested for fabric encrustation by repeated washing of cotton fabric at 35° C. with water hardness at 250 ppm (2/1 Ca/Mg ratio). In carrying out the test, four 25.4 cm.×25.4 cm., 100% black cotton fabric swatches along with 0.907 kg. of ballast is washed for 12 min. with 113.4 g of the detergent composition being tested. After washing is completed, 2.00–4.00 g of the calcium carbonate encrusted fabrics are extracted in 100 ml. of 0.2N hydrochloric acid for 30 min. and a 2.0–4.0 ml. aliquot is analyzed for hardness by the EDTA titration method. Encrustation is expressed as mg. calcium carbonate per gram of fabric.

Table I indicates the fabric encrustation as mg $CaCO_3$ per gram of fabric after ten washing machine cycles of use.

TABLE I

| Example | Fabric Encrustation |
|---|---|
| 1 | 16.3 |
| A | 101.7 |
| B | 21.5 |

The results of Table I show a much smaller degree of fabric encrustation when small amounts of both STPP and polyacrylate are present (Example 1) than is indicated by the fabric encrustation obtained when only polyacrylate (Comparative Example A) or STPP (Comparative Example B) is present in the composition.

EXAMPLE 2 AND COMPARATIVE EXAMPLES C AND D

These examples show the unexpectedly high degree of cleaning ability as measured by soil anti-redeposition, resulting from use of the detergent composition of this invention.

In Example 2, the same quantities of components were compounded as shown for Example 1, except that 0.5 rather than 1.0 part of STPP, 0.28 rather than 0.5 part of polyacrylate, and 9.3 rather than 8.8 parts of water were utilized.

In Comparative Example C, the same quantities of components were compounded as specified for Example 2 except that the STPP was omitted, and 0.56 rather than 0.28 part of polyacrylate, and 8.8 rather than 9.3 parts of water were utilized.

In Comparative Example D, the same quantities of components were compounded as specified for Example 2 except that the polyacrylate was omitted, and 1.0 rather than 0.5 part of STPP and 8.8 rather than 9.3 parts of water were utilized.

The detergent compositions of these examples were tested for soil anti-redeposition, a measure of cleaning ability, by washing at 35° C. and 150 ppm. (2/1 Ca/Mg ratio) of hardness, ten replicate cotton and polycotton (a blend of 65 wt. % cotton and 35 wt. % polyester) swatches with the compositions in the presence of background soil, and determining the reflectances after six cycles of washing. A modified AATCC Test method 15.2-1985 was used, wherein oil and clay soiled polycotton pillowcases as a source for soil are washed along with clean 100% cotton or polycotton swatches. A freshly soiled polycotton pillowcase as a source for soil was provided after each cycle while the cotton or polycotton swatches remained the same. Reflectances of the test swatches are read in a Gardner 2000 colormeter after the sixth cycle.

Table II indicated the averages of the reflectances obtained for the cotton and polycotton samples.

TABLE II

| Example | Cotton Reflectance | Polycotton |
|---|---|---|
| 2 | 113.3 | 81.9 |
| C | 111.2 | 70.5 |
| D | 110.8 | 79.1 |

The results of Table II show better cleaning ability of the detergent composition indicated by anti-soil redeposition as determined by higher reflectances of both the cotton and polycotton samples when small amounts of both STPP and polyacrylate are present (Example 2) than when no STPP is present but twice the amount of polyacrylate was present as was present in Example 2 (Comparative Example C), or when no polyacrylate was present but twice the amount of STPP was present as was present in Example 2 (Comparative Example D).

EXAMPLES 3, 4 AND 5 AND COMPARATIVE EXAMPLES E TO J

In these examples which involve values of turbidity, a test for turbidity was used, the results of which correlate with the fabric encrustation caused by the employment of a carbonate built detergent composition, with lower turbidity indicating lower fabric encrustation.

In each of these examples, turbidity determinations were carried out using solutions of a base detergent composition comprising 80 parts sodium carbonate, 0.5 parts of sodium bicarbonate, an active surfactant consisting of 6.0 parts of the sodium salt of a sulfated $C_{12}$–$C_{15}$ alcohol (anionic surfactant) and 3.2 parts of a $C_{12}$–$C_{15}$ alcohol ethoxylated with 3 moles of ethylene oxide per mole of alcohol (nonionic surfactant) and either no STPP and no polymer, i.e. polymeric polycarboxylate (Example E), 0.15 wt. % of STPP (Example F) 0.5 wt. % of any of three polymers and no STPP (Examples G, H and I) or both 0.15 wt. % of STPP and 0.5 wt. % of any of the three polymers (Examples 3, 4 and 5). The foregoing three polymers were respectively 1) sodium polyacrylate having a weight average molecule weight of 4500: 2) an at least partially neutralized homopolymer of maleic acid having a weight average molecular weight of about 1000: and 3) an at least partially neutralized copolymer of 15 wt. % of maleic acid and 85 wt. % of acrylic acid having a weight average molecular weight of about 6000.

The turbidity determinations were obtained as follows:

To a clean 2 liter beaker containing mL of distilled water at 95° F. preadjusted to a Ca and Mg hardness of 250 ppm with a Ca:Mg molar ratio of 2:1, was added 0.16 wt. % of the detergent formulation being tested and stirring was begun simultaneously with the starting of a timer. Stirring of the combined solution was continued and the turbidity of the solutions were measured with a Hach Turbidimeter in National Turbidity Units (NTU's) at set time intervals of 1, 5, 10, 15, 20 and 30 min. Results of these measurements for the various detergent formulations are shown in Table III.

TABLE III

| | | Turbidity (NTU) | | | | | |
|---|---|---|---|---|---|---|---|
| Example | Additives | 1 min | 5 min | 10 min | 15 min | 20 min | 30 min |
| E | no STPP, no polymer | 316 | 368 | 392 | 418 | 426 | 441 |
| F | STPP only | 1 | 187 | 247 | 260 | 272 | 298 |
| G | polymer 1) only | 2 | 5 | 69 | 116 | 125 | 128 |
| 3 | polymer 1) & STPP | 2 | 2 | 34 | 83 | 100 | 114 |
| H | polymer 2) only | 2 | 8 | 103 | 118 | 118 | 126 |
| 4 | polymer 2) & STPP | 2 | 2 | 2 | 4 | 64 | 86 |
| I | polymer 3) only | 2 | 9 | 83 | 96 | 100 | 100 |
| 5 | polymer 3) & STPP | 2 | 3 | 8 | 49 | 66 | 71 |

The results of Table III show that while phosphate alone, and each of the three polymers alone inhibits $CaCO_3$ formation, the combination of phosphate and each of the three polymers inhibits $CaCO_3$ formation more effectively than the phosphate or any of the polymers alone.

We claim:

1. A powdered laundry detergent composition comprising about 5 to 24 wt. % of an active surfactant including anionic and nonionic surfactants, wherein said anionic surfactant is an alkali metal salt of sulfated linear $C_{12}$–$C_{16}$ alcohols ethoxylated with an average of 1 to 12 moles of ethylene oxide per mole of alcohol, and said nonionic surfactant consists of $C_{12}$–$C_{16}$ linear alcohols ethoxylated with an average of 1 to 12 moles of ethylene oxide per mole of alcohol, at least about 70 wt. % of sodium carbonate, about 0.1 to 2 wt. % of a phosphorus-containing sequestering agent, about 0.1 to 2 wt. % of an at least partially neutralized polymeric polycarboxylate, and about 1–12 wt. % water, said anionic surfactant being present in an amount greater than that of said nonionic surfactant and in the range of about 4 to 16 wt. %, said nonionic surfactant being present in the range of about 2 to 8 wt. % and said at least partially neutralized polymeric polycarboxylate having a number average molecular weight of about 1000 to 10,000.

2. The composition of claim 1 comprising about 5 to 15 wt. % of said surfactant, about 75 to 85 wt. % of said alkali metal carbonate, about 0.2 to 2 wt. % of said phosphorus-containing sequestering agent, about 0.1 to 1.5 wt. % of said polymeric polycarboxylate, and about 2 to 10 wt. % of water.

3. The composition of claim 1 comprising about 75 to 80 wt. % of sodium carbonate and about 0.1 to 15 wt. % of sodium bicarbonate.

4. The composition of claim 1 wherein said phosphorus-containing sequestering agent is sodium tripolyphosphate.

5. The composition of claim 1 wherein said phosphorus-containing sequestering agent is an aminomethylene phosphonate.

6. The composition of claim 1 wherein said polymeric polycarboxylate is an at least partially neutralized polymer of maleic acid.

7. The composition of claim 6 wherein said polymeric polycarboxylate is a homopolymer of maleic acid.

8. The composition of claim 6 wherein said polymeric polycarboxylate is a copolymer of acrylic acid and maleic acid.

9. The composition of claim 8 wherein said copolymer is comprised of about 50 to 90 wt. % of acrylic acid and about 50 to 10 wt. % of maleic acid.

10. A process comprising washing a fabric in an aqueous washing liquor containing the composition of claim 1.

11. The composition of claim 4 wherein said sodium carbonate is present in an amount of at least 75 wt. %.

* * * * *